US009498951B2

(12) United States Patent
Mallinson et al.

(10) Patent No.: US 9,498,951 B2
(45) Date of Patent: Nov. 22, 2016

(54) INKJET NOZZLE DEVICE HAVING DUAL CHAMBER INLETS AND TWOFOLD SYMMETRY

(71) Applicant: MEMJET TECHNOLOGY LIMITED, Dublin (IE)

(72) Inventors: Sam Mallinson, North Ryde (AU); Philip Palma, North Ryde (AU); David Secker, North Ryde (AU); Paul Reichl, North Ryde (AU); Glenn Horrocks, North Ryde (AU); Angus North, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 14/628,186

(22) Filed: Feb. 20, 2015

(65) Prior Publication Data

US 2015/0251421 A1 Sep. 10, 2015

Related U.S. Application Data

(60) Provisional application No. 61/947,686, filed on Mar. 4, 2014.

(51) Int. Cl.
*B41J 2/14* (2006.01)

(52) U.S. Cl.
CPC ..... *B41J 2/1412* (2013.01); *B41J 2002/14467* (2013.01)

(58) Field of Classification Search
None
See application file for complete search history.

(56) References Cited

U.S. PATENT DOCUMENTS

| | | | | |
|---|---|---|---|---|
| 2005/0280670 | A1* | 12/2005 | Chuang et al. | 347/61 |
| 2007/0081035 | A1* | 4/2007 | Worsman et al. | 347/56 |
| 2012/0062654 | A1* | 3/2012 | Delametter | H04L 43/12 347/50 |
| 2013/0208052 | A1* | 8/2013 | Silverbrook | 347/61 |

* cited by examiner

*Primary Examiner* — Bradley Thies
(74) *Attorney, Agent, or Firm* — Cooley LLP

(57) ABSTRACT

An inkjet nozzle device includes: a nozzle chamber having a floor, a roof and perimeter sidewalls extending between the floor and the roof, wherein a nozzle aperture is defined in the roof; a heating element for generating gas bubbles in the nozzle chamber so as to eject ink through the nozzle aperture, wherein a centroid of the heating element is aligned with a centroid of the nozzle aperture; and a pair of chamber inlets defined in the floor of the nozzle chamber, the chamber inlets being symmetrically disposed about the centroid of the heating element. The inkjet nozzle device has a pair of orthogonal symmetry planes passing through the centroid of the nozzle aperture.

10 Claims, 2 Drawing Sheets

INKJET NOZZLE DEVICE HAVING DUAL CHAMBER INLETS AND TWOFOLD SYMMETRY

FIELD OF THE INVENTION

This invention relates to inkjet printheads, such as thermal bubble-forming inkjet printheads. It is has been developed primarily for improving ink flow into nozzle chambers and minimizing formation of satellite droplets during droplet ejection.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead in combination with a feed mechanism which feeds print media past the printhead in a single pass. Memjet® printers therefore provide much higher printing speeds than conventional scanning inkjet printers.

An inkjet printhead is comprised of a plurality (typically thousands) of individual inkjet nozzle devices, each supplied with ink. Each inkjet nozzle device typically comprises a firing chamber having a nozzle aperture and an actuator for ejecting ink through the nozzle aperture. The design space for inkjet nozzle devices is vast and a plethora of different nozzle devices have been described in the patent literature, including different types of actuators and different device configurations.

One of the most important criteria in designing an inkjet nozzle device is achieving ink drop trajectories perpendicular to the nozzle plane. If each drop is ejected perpendicularly outward, the tail following the drop will not catch and deposit on the nozzle edge; a source of flooding and drop misdirection is thus avoided. Additionally, with perpendicular trajectories, the primary satellite formed by breakup of the droplet tail can be made to land on top of the main drop on the page, hiding that satellite. Significant improvements in print quality can therefore be obtained with perpendicular drop trajectories.

However, inkjet nozzle devices usually have an inherent degree of asymmetry, which means that ink droplets may be ejected somewhat skewed from the nozzle plate of the printhead. With skewed droplet ejection, satellite droplets tend to land on print media at a different position than the main droplet and this causes a reduction in print quality.

Hitherto, most attempts to minimize the effects of satellites have focused on compensating for asymmetry in the nozzle device. For example, U.S. Pat. No. 7,780,271 (assigned to Zamtec Ltd) describes an inkjet nozzle device having a heating element which is offset from the nozzle aperture. The offset compensates for asymmetric bubble formation in the firing chamber and enables non-skewed droplet ejection.

U.S. Pat. No. 5,666,143 (assigned to Hewlett-Packard Company) describes inkjet nozzle devices having multiple chamber inlets. Each nozzle chamber has a pair of side inlets and each nozzle chamber is asymmetric.

U.S. Pat. No. 7,841,697 (assigned to Zamtec Ltd) describes inkjet nozzle devices having multiple chamber inlets. Each nozzle chamber has one inlet defined in a sidewall and one inlet defined in floor of the nozzle chamber.

It would be desirable to provide an inkjet nozzle device, which minimizes satellite droplet formation and improves print quality. It would be further desirable to provide an inkjet nozzle device with improved ink flow into nozzle chambers and greater tolerance to blockages in chamber inlets.

SUMMARY OF INVENTION

In accordance with the present invention, there is provided an inkjet nozzle device comprising:

a nozzle chamber having a floor, a roof and perimeter sidewalls extending between the floor and the roof, wherein a nozzle aperture is defined in the roof; and a heating element for generating gas bubbles in the nozzle chamber so as to eject ink through the nozzle aperture, wherein a centroid of the heating element is aligned with a centroid of the nozzle aperture; and a pair of chamber inlets defined in the floor of the nozzle chamber, the chamber inlets being symmetrically disposed about the centroid of the heating element, wherein the inkjet nozzle device has a pair of orthogonal symmetry planes passing through the centroid of the nozzle aperture.

Inkjet nozzle devices according to the present invention provide the advantage of redundancy in the ink supply to each nozzle chamber by virtue of the pair of chamber inlets. Redundancy in the ink supply makes the device more tolerant to potential blockages from particulates or bubbles in the ink. A more significant advantage of the inkjet nozzle devices according to the present invention is that there is twofold symmetry in the nozzle chamber about nominal x- and y-axes. This symmetry provides symmetric bubble formation and expansion, and consequently provides non-skewed ink droplet ejection. With non-skewed ejections, the effects of any satellite droplets are minimized.

The heating element (otherwise known in the art as a "resistive heating element" or simply "heater") may either be suspended in the nozzle chamber or bonded to a floor of the nozzle chamber.

Preferably, the heating element comprises an elongate rectangular bar having longitudinal edges extending between first and second ends. The nozzle aperture may have any suitable shape, but is typically either circular or elliptical. In the case of elliptical nozzle apertures, a major of axis of the elliptical nozzle aperture is preferably aligned with and extends parallel with a central longitudinal axis of the heating element for optimum ejection efficiency.

In one embodiment, the chamber inlets are symmetrically disposed at either side of the longitudinal edges.

In an alternative embodiment, the chamber inlets are symmetrically disposed at either side of the first and second ends.

Preferably, the device further comprises a pair of baffle plates symmetrically disposed about the centroid of the heating element. The baffle plates assist in controlling ink flow into the chamber, as well as minimizing backflow of ink from the chamber during bubble expansion. The baffle plates may be apertured so as to tune refill or backflow rates of the nozzle chamber accordingly.

In one embodiment, the baffle plates extend parallel with the roof of the nozzle chamber. In accordance with this embodiment, each baffle plate is preferably suspended over a respective chamber inlet. Preferably, the heating element is suspended in the nozzle chamber and each baffle plate is coplanar with the heating element. Typically, the heating element and coplanar baffle plates are comprised of a same material by virtue of being co-deposited during MEMS fabrication of the inkjet nozzle device. However, unlike the heating element, the baffle plates are not connected to any drive circuitry and are therefore entirely passive and non-heating.

In an alternative embodiment, each baffle plate extends between a floor and a roof of the nozzle chamber, with each baffle plate being positioned between a respective chamber inlet and the heating element. In this embodiment, the baffle plates are typically comprised of a same material as the perimeter sidewalls by virtue of co-deposition during MEMS fabrication.

BRIEF DESCRIPTION OF THE DRAWINGS

Embodiments of the present invention will now be described by way of example only with reference to the accompanying drawings, in which.

DETAILED DESCRIPTION OF AN EMBODIMENT OF THE INVENTION

Figure 1:
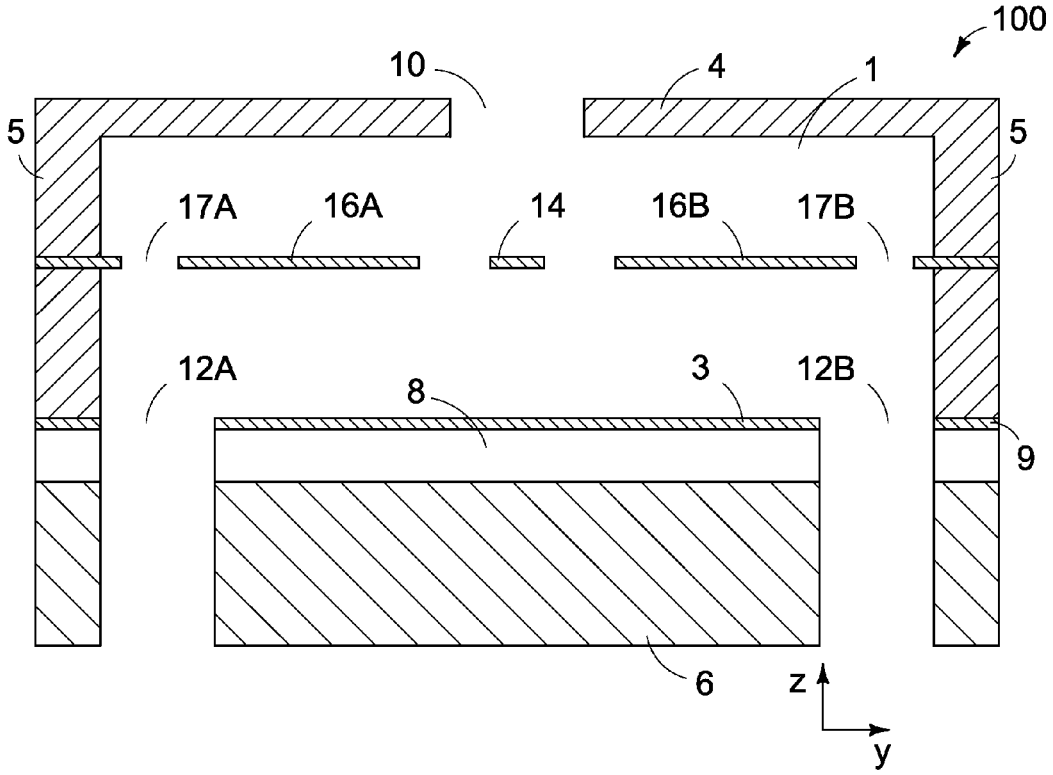
FIG. 1 a schematic sectional side view of an inkjet nozzle device according to a first embodiment.
Figure 2:
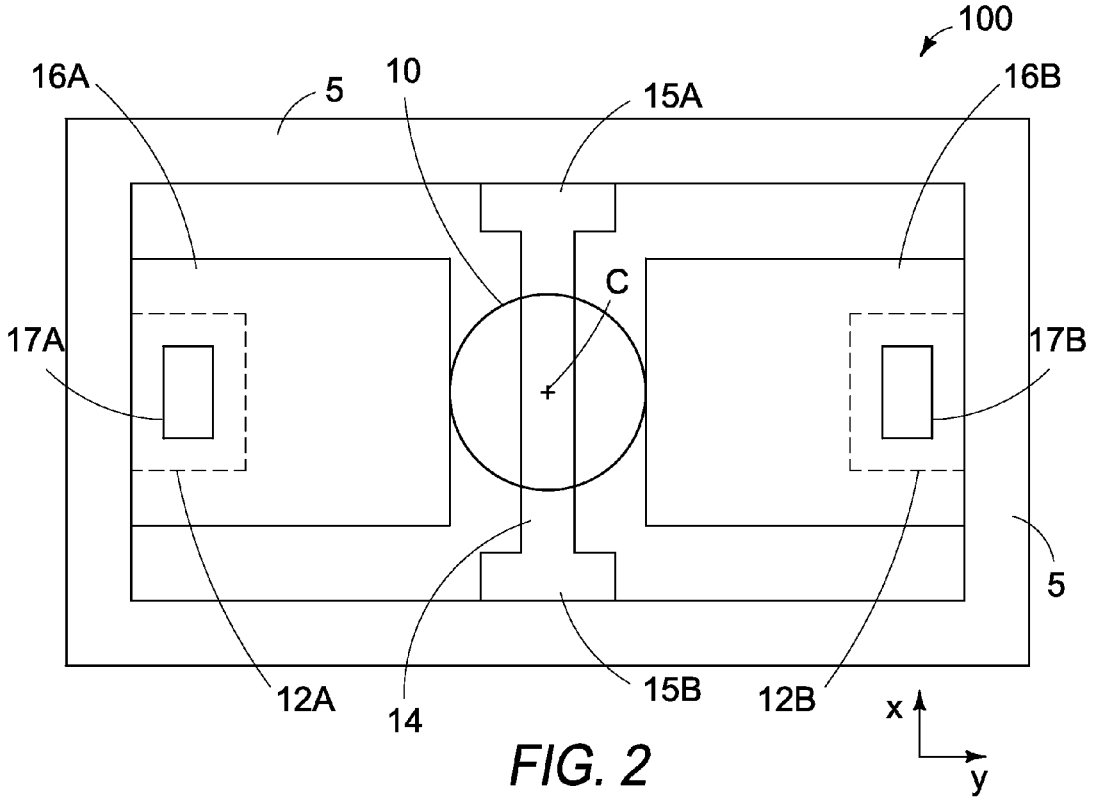
FIG. 2 is a plan view of the inkjet nozzle device shown in FIG. 1.

Referring to FIGS. 1 and 2, there are shown schematic side sectional and plan views of an inkjet nozzle device 100 according to a first embodiment of the invention. The inkjet nozzle device 100 comprises a nozzle chamber 1 having a floor 3, a roof 4 and perimeter sidewalls 5 extending between the floor and the roof. The perimeter sidewalls 5 are continuous and define an extent of the nozzle chamber 1. (For the avoidance of doubt, the roof in FIG. 2 is shown as a transparent structure to reveal details of the nozzle chamber 1, including the perimeter sidewalls 5). Typically, the roof 4 and/or sidewalls 5 are comprised of same or different material. Suitable materials include ceramic materials (e.g. silicon nitride, silicon oxide and combinations thereof) and polymeric materials, such as epoxy-based photoresists (e.g. SU-8).

The nozzle device 100 is disposed on a silicon substrate 6 having a passivated CMOS layer 8. In particular, a passivation layer 9 (e.g. silicon dioxide) disposed on the CMOS layer 8 defines the floor 3 of the nozzle chamber 1. It will be appreciated that the nozzle device 100 may be constructed using a MEMS fabrication process, by analogy with the process described in, for example, U.S. Pat. No. 7,246,886, the contents of which are incorporated herein by reference.

A circular nozzle aperture 10 is defined in the roof 4 and a pair of chamber inlets 12A and 12B are defined in the floor 3 of the nozzle chamber 1. The chamber inlets 12A and 12B extend through the silicon substrate 6 to meet with ink supply channels (not shown) defined in a backside of the substrate. From FIG. 2, it can be seen that a centroid C of the nozzle aperture 10 and the roof 4 are coincident, and the chamber inlets 12A and 12B are symmetrically disposed with respect to the centroid C of the nozzle aperture.

Figure 3:
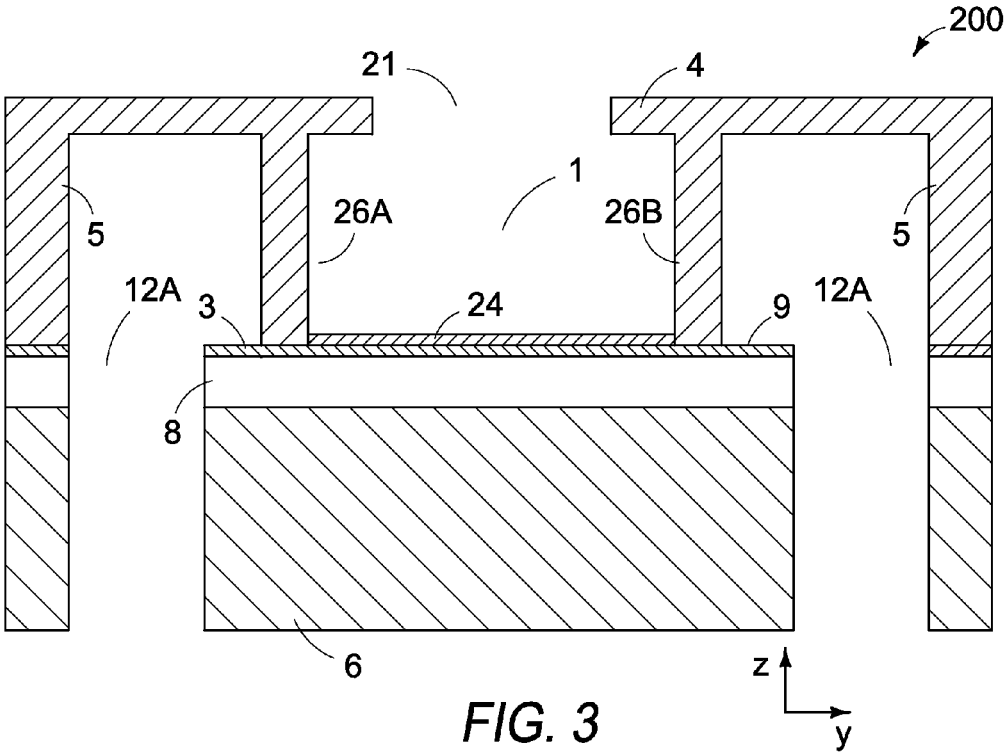
FIG. 3 a schematic sectional side view of an inkjet nozzle device according to a second embodiment.
Figure 4:
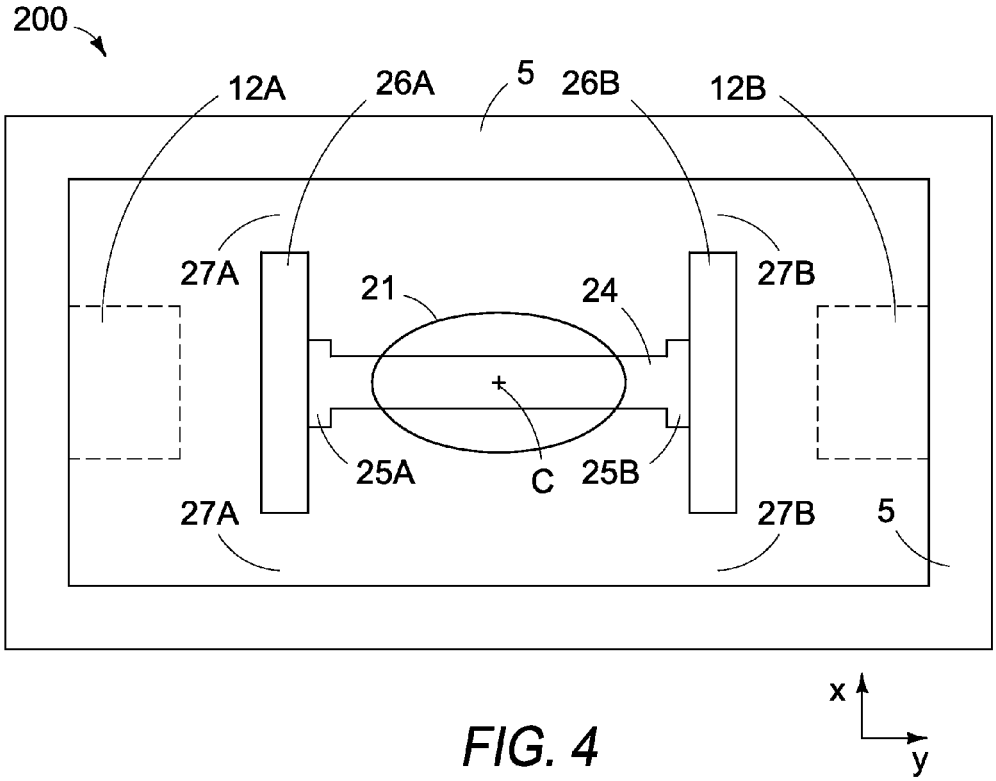
FIG. 4 is a plan view of the inkjet nozzle device shown in FIG. 3.

Although a circular nozzle aperture 10 is shown in FIG. 2, it will be appreciated that the nozzle aperture may be, for example, elliptical having a major axis aligned with the central longitudinal axis of the heating element. An elliptical nozzle aperture is shown in FIGS. 3 and 4, and elliptical nozzle apertures are also described in, for example, U.S. Pat. No. 7,857,428 and U.S. Application No. 61/859,889 filed on 30 Jul. 2013, the contents of which are herein incorporated by reference.

A heating element 14 is suspended in the nozzle chamber 1 directly below the nozzle aperture 10, such that a centroid of the heating element is aligned with the centroid C of the nozzle aperture. The heating element 14 takes the form of an elongate rectangular bar, having a central longitudinal axis extending along a nominal x-axis of the chamber and aligned with a diameter of the nozzle aperture 10. The heating element 14 is connected to drive circuitry in the underlying CMOS layer 8 via electrodes 15A and 15B.

A pair of baffle plates 16A and 16B are suspended in the nozzle chamber 1 and symmetrically disposed with respect to opposite longitudinal edges of the heating element 14. Likewise, the chamber inlets 12A and 12B are symmetrically disposed with respect to opposite longitudinal edges of the heating element 14.

The baffle plates 16A and 16B and the heating element 14 are coplanar and parallel with a plane of the roof 4. Typically, the baffle plates 16A and 16B and the heating element 14 are comprised of a same material, being formed simultaneously during MEMS fabrication via a deposition and etching process. For example, the heating element 14 and baffle plate 16A and 16B may both be comprised of a metal alloy (e.g. TiAl) or a conductive ceramic material (e.g. TiAlN). Of course, only the heating element 14 is connected to drive circuitry in the CMOS layer 8, with the baffle plates 16A and 16B being entirely passive.

Each baffle plate 16A and 16B is suspended over a respective chamber inlet 12A and 12B so as to control ink flow into the nozzle chamber 1. Each baffle plate 16A and 16B optionally has a respective baffle aperture 17A and 17B defined therein to provide optimal ink flow into the chamber 1. As shown in FIG. 2, the baffle apertures 17A and 17B overlap with respective chamber inlets 12A and 12B.

Still referring to FIGS. 1 and 2, the nozzle chamber 1 nominally has an x-axis extending along a width dimension, a y-axis extending along a length dimension and a z-axis extending along a height dimension. In accordance with the present invention, there are two orthogonal planes of symmetry passing through the centroid C of the nozzle aperture 10. In other words, the nozzle device 100 has perfect symmetry about the x- and y-axes.

This high degree of symmetry in the nozzle device 100 provides excellent drop ejection characteristics due to highly symmetric bubble expansion in the nozzle chamber 1. Symmetric bubble expansion leads to non-skewed droplet ejection from the nozzle aperture 10 and minimization of satellite droplets. With non-skewed droplet ejection and minimal satellites, the nozzle device 100 has the advantage of improved overall print quality compared to nozzle devices lacking the two orthogonal planes of symmetry. A further advantage of the nozzle device 100 is redundancy in the supply of ink to the nozzle chamber 1, meaning that the device is still functional even if one of the chamber inlets 12A or 12B becomes blocked.

Referring now to FIGS. 3 and 4, there are shown schematic side sectional and plan views of an inkjet nozzle device 200 according to a second embodiment of the invention. For the sake of clarity, where appropriate, like reference numerals are used to indicate like features in the nozzle device 100 and the nozzle device 200. Thus, the nozzle device 200 comprises a nozzle chamber 1 having a floor 3, a roof 4 and perimeter sidewalls 5 extending between the floor and the roof. Further, by analogy with the device 100 shown in FIGS. 1 and 2, the nozzle device 200 is disposed on a silicon substrate 6 having a passivated CMOS layer 8. It will be appreciated that the nozzle device 200 may be constructed using a suitable MEMS fabrication process, as described in, for example, U.S. Application No. 61/859,889 filed on 30 Jul. 2013, the contents of which are herein incorporated by reference.

An elliptical nozzle aperture 21 is defined in the roof 4 and a pair of chamber inlets 12A and 12B are defined in the floor 3 of the nozzle chamber 1. From FIG. 4, it can be seen that a centroid C of the nozzle aperture 21 and the roof 4 are coincident, and the chamber inlets 12A and 12B are symmetrically disposed with respect to the centroid C of the nozzle aperture. Although an elliptical nozzle aperture 21 is shown in FIG. 4, it will of course be appreciated that the nozzle aperture may be, for example, circular as shown in FIG. 2.

A bonded heating element 24 is bonded to the floor 3 of the nozzle chamber 1 directly below the nozzle aperture 21, such that a centroid of the heating element is aligned with the centroid C of the elliptical nozzle aperture. The bonded heating element 24 takes the form of an elongate rectangular bar, having a central longitudinal axis extending along a nominal y-axis of the chamber and aligned with a major axis of the nozzle aperture 21. The bonded heating element 24 is connected to drive circuitry in the underlying CMOS layer 8 via electrodes 25A and 25B.

A pair of baffle plates in the form of baffle walls 26A and 26B are positioned in the nozzle chamber 1 and symmetrically disposed at opposite ends of the bonded heating element 24. Likewise, the chamber inlets 12A and 12B are symmetrically disposed with respect to opposite ends of the bonded heating element 24.

The baffle walls 26A and 26B extend between the floor 3 and the roof 4 of the nozzle chamber 1, and are perpendicular with respect to the roof. Typically, the baffle walls 26A and 26B and perimeter sidewalls 5 are comprised of a same material, being formed simultaneously during MEMS fabrication via a deposition and etching process. For example, the sidewalls 5 and baffle walls 26A and 26B may both be comprised of a ceramic material (e.g. silicon oxide) or a polymer material (e.g. SU-8).

Each baffle wall 26A and 26B is flanked by a respective pair of side apertures 27A and 27B. The side apertures 27A and 27B control the flow of ink into a firing chamber, which is defined by a space between the baffle walls 26A and 26B containing the bonded heating element 24. With reference to U.S. Application No. 61/859,889, the width of the side apertures 27A and 27B may be varied to optimize ink flow into and out of the firing chamber, with the condition that each of the side apertures 27A and 27B necessarily has the same dimensions in order to maintain symmetry.

As shown in FIGS. 3 and 4, the nozzle device 200 nominally has an x-axis extending along a width dimension, a y-axis extending along a length dimension and a z-axis extending along a height dimension. In accordance with the present invention, there are two orthogonal planes of symmetry passing through the centroid C of the elliptical nozzle aperture 21. In other words, the nozzle device 200 has perfect symmetry about the x- and y-axes.

It will be appreciated that the nozzle device 200 is analogous with the device described in U.S. Application No. 61/859,889. However, by contrast with the device described in U.S. Application No. 61/859,889, the nozzle device 200 has full symmetry about its x-axis by virtue of the dual chamber inlets 12A and 12B, and the dual baffle walls 26A and 26B. In view of this symmetry, the nozzle device 200 has similar advantages to those described in connection with the nozzle device 100.

It will, of course, be appreciated that the present invention has been described by way of example only and that modifications of detail may be made within the scope of the invention, which is defined in the accompanying claims.

The invention claimed is:

1. An inkjet nozzle device comprising:

a nozzle chamber having a floor, a roof and perimeter sidewalls extending between the floor and the roof, wherein a nozzle aperture is defined in the roof; and a single heating element for generating gas bubbles in the nozzle chamber so as to eject ink through the nozzle aperture, wherein a centroid of the heating element is aligned with a centroid of the nozzle aperture;

a pair of chamber inlets defined in the floor of the nozzle chamber, the chamber inlets being symmetrically disposed about the centroid of the heating element; and a pair of opposed baffle plates symmetrically disposed about the centroid of the heating element, wherein:

the inkjet nozzle device has a pair of orthogonal symmetry planes passing through the centroid of the nozzle aperture;

each baffle plate extends between a floor and a roof of the nozzle chamber, each baffle plate being positioned between a respective chamber inlet and the heating element;

a central longitudinal axis of the heating element bisects each baffle plate; and each baffle plate is wider than the heating element.

2. The inkjet nozzle device of claim 1, wherein the heating element is suspended in the nozzle chamber or bonded to a floor of the nozzle chamber.

3. The inkjet nozzle device of claim 1, wherein the heating element comprises an elongate rectangular bar having longitudinal edges extending between first and second ends.

4. The inkjet nozzle device of claim 3, wherein the chamber inlets are symmetrically disposed about the longitudinal edges.

5. The inkjet nozzle device of claim 3, wherein the chamber inlets are symmetrically disposed on either side of the first and second ends.

6. The inkjet nozzle device of claim 1, wherein the chamber inlets are symmetrical disposed about the ends of the heating element.

7. The inkjet nozzle device of claim 1, wherein the nozzle aperture is circular or elliptical.

8. The inkjet nozzle device of claim 1, wherein the perimeter sidewalls are continuous and define an extent of the nozzle chamber.

9. The inkjet nozzle device of claim 1, wherein each baffle plate is flanked by a respective pair of side apertures.

10. The inkjet nozzle device of claim 9, wherein the side apertures control a flow of ink into a firing chamber, the firing chamber being defined by a space between the opposed baffle plates containing the heating element.

* * * * *